US010100502B2

(12) United States Patent
Dudley et al.

(10) Patent No.: US 10,100,502 B2
(45) Date of Patent: Oct. 16, 2018

(54) SYPHON ASSEMBLY AND ACTUATOR THEREFOR

(71) Applicant: THOMAS DUDLEY LIMITED, Dudley, West Midlands (GB)

(72) Inventors: Martin Dudley, Bridgnorth (GB); Robert Andrew Holmes, West Midlands (GB)

(73) Assignee: Thomas Dudley Limited, Dudley, West Midlands (GB)

( * ) Notice: Subject to any disclaimer, the term of this patent is extended or adjusted under 35 U.S.C. 154(b) by 130 days.

(21) Appl. No.: 15/021,356

(22) PCT Filed: Sep. 11, 2015

(86) PCT No.: PCT/GB2015/052644

§ 371 (c)(1),
(2) Date: Mar. 11, 2016

(87) PCT Pub. No.: WO2016/038392

PCT Pub. Date: Mar. 17, 2016

(65) Prior Publication Data

US 2016/0273200 A1 Sep. 22, 2016

Related U.S. Application Data

(63) Continuation-in-part of application No. PCT/GB2014/052762, filed on Sep. 12, 2014.

(30) Foreign Application Priority Data

Sep. 12, 2013 (GB) ..... 1316243.3
Sep. 23, 2014 (GB) ..... 1416802.5

(51) Int. Cl.
*E03D 1/06* (2006.01)
*E03D 1/08* (2006.01)
(Continued)

(52) U.S. Cl.
CPC ..... *E03D 1/087* (2013.01); *E03D 1/141* (2013.01); *E03D 1/36* (2013.01); *E03D 5/024* (2013.01)

(58) Field of Classification Search
CPC ..... E03D 1/087; E03D 1/08; E03D 1/085; E03D 1/141; E03D 1/36; E03D 5/02; B67D 7/763
(Continued)

(56) References Cited

U.S. PATENT DOCUMENTS 203,071 A * 4/1878 Rhoads ..... E03D 1/22 4/364
326,431 A * 9/1885 Jennings ..... E03D 1/22 4/364
(Continued)

FOREIGN PATENT DOCUMENTS

CN 203795555 U 8/2014
GB 1531451 A 11/1978

*Primary Examiner* — Benjamin R Shaw
(74) *Attorney, Agent, or Firm* — Baker Donelson, PC; Royal W. Craig

(57) ABSTRACT

A fill valve assembly (9, 109) for connection with a flushing syphon or other flushing valve. The assembly (9, 109) includes a float operated equilibrium valve (90, 190) and a branch element (92, 192) fluidly connected upstream the equilibrium valve (90, 190) and including an outlet (98) for providing fluid flow to one or more fluid pressure driven actuators (6).

16 Claims, 9 Drawing Sheets

(51) Int. Cl.
*E03D 1/14* (2006.01)
*E03D 1/36* (2006.01)
*E03D 5/02* (2006.01)

(58) Field of Classification Search
USPC ..... 4/376
See application file for complete search history.

(56) References Cited

U.S. PATENT DOCUMENTS 515,527 A * 2/1894 Lewis ..... E03D 1/082 4/376
3,987,501 A * 10/1976 Anderson ..... E03D 1/304 4/394
3,994,029 A * 11/1976 Badders ..... E03D 1/36 137/445
4,230,145 A * 10/1980 Badders ..... E03D 1/30 137/410
4,268,924 A * 5/1981 Price ..... E03D 3/12 4/324
4,649,953 A * 3/1987 Dudley ..... E03D 1/06 137/148
4,882,792 A * 11/1989 Vincent ..... E03D 5/024 134/169 R
5,761,748 A * 6/1998 Smith ..... E03D 1/087 4/313
5,855,024 A * 1/1999 Smith ..... E03D 1/087 4/325
6,256,801 B1 * 7/2001 Mohr ..... E03D 1/087 137/143
6,263,519 B1 * 7/2001 Parsons ..... E03D 1/34 4/300
6,321,395 B1 * 11/2001 Parsons ..... E03D 3/06 251/29
6,370,707 B1 * 4/2002 Parsons ..... E03D 1/142 251/29
2002/0092091 A1 * 7/2002 Parsons ..... E03D 1/142 4/378
2002/0116754 A1 * 8/2002 Icking ..... E03D 1/142 4/366
2010/0224805 A1 * 9/2010 Oury ..... E03D 1/144 251/58
2013/0152292 A1 * 6/2013 Yu ..... E03D 1/36 4/378

* cited by examiner 8
81
81d
83
86b
86a
86
85
85a
80
83d 86b
86a
85b
85
86
82b
82
82c
83c
84b
83b
83a
83e
83d
83
87

84d
84f
84a
84c
84e
84i
84g
84h
81a
81c
81d
84
83a'
82a
84
82
85
85a
86
81
83

85
85a
82
82a
84
84d
83a
83f
81e
86
81d
81b
83

SYPHON ASSEMBLY AND ACTUATOR THEREFOR

CROSS-REFERENCE TO RELATED APPLICATION(S)

The present application is the national phase entry of PCT patent application No PCT/GB2015/052644 filed on 11 Sep. 2015 (which claims priority from the earlier national British application 1416802.05 filed on Sep. 23, 2014) and is a Continuation-In-Part of pending International PCT Application PCT/GB2014/052762 filed Sep. 12, 2014 (which claims priority from the earlier national British application 1316243.3 filed on Sep. 12, 2013).

This invention relates to valve assemblies and more particularly to a valve assembly for use in flushing cisterns. More specifically, although not exclusively, this invention relates to fill valve assemblies for use with flushing systems incorporating a draining syphon or other flushing valves.

This invention relates to syphon assemblies for flushing cisterns and actuators for operating such syphon assemblies. More specifically, although not exclusively, this invention relates to a syphon assembly incorporating a piston that is operated by an actuator for initiating the syphonic action and to the actuator assembly.

Draining syphons of this kind are generally operated by a lever whose end is connected to a piston rod attached to the piston such that actuation of the lever raises the piston, thereby raising the level of water within the syphon over the bight of the U and priming the syphon to initiate the syphonic action. Actuation of the piston requires a significant amount of force as it involves displacing a considerable volume of water.

It is a non-exclusive object of the invention to provide a draining system with one or more components that overcomes or at least mitigates the issues associated with known systems. It is a more general non-exclusive object of the invention to provide an improved cistern draining system.

According to one aspect of the present invention there is provided a valve assembly, for example a fill valve assembly for inclusion or incorporation into a cistern flushing system or assembly, e.g. a syphon assembly as described below or a different type of flushing valve, the assembly comprising a float operated equilibrium valve and a branch element operatively and/or fluidly connected upstream the equilibrium valve and including an outlet for providing fluid flow to one or more fluid pressure driven actuators.

The branch element is preferably be integral with the fill valve assembly, for example such that the assembly is provided as a unitary structure, e.g. with a unitary or common housing, which may be provided in two or more parts secured together as unitary structure.

The branch element may extend from the fill valve assembly, for example at an angle which may be a right angle with respect to the flow direction, e.g. horizontally in use. The fill valve assembly may comprise two or more outlets, each of which may be at different positions and/or orientations on or in the fill valve assembly, for example wherein the branch element may be selectively connected or operatively or fluidly connected to, one of the outlets. In embodiments, the fill valve assembly comprises two outlets on opposed portions or sides of the fill valve assembly, for example such that the branch element may be connected to the fill valve assembly at one of its sides and/or in one of two orientations, e.g. which orientations may be at a straight or 180° angle with respect to one another.

The fill valve assembly may comprise one outlet on either of its sides for cooperative and/or sealing engagement with an inlet or inlet member of the branch element. The fill valve assembly may further comprise a clamp element for securing the branch element or the inlet or inlet member thereof to the fill valve assembly or to one of its sides and/or in cooperative engagement and/or with respect to one of the outlets. The branch element may be reversible.

In some embodiments, the branch element or inlet or inlet member may comprise an inlet spigot and/or may comprise a portion that is receivable within or that receives at least a portion of one of the outlets. The branch element or inlet or inlet member or spigot or portion thereof may comprise a flange or groove, for example a circumferential flange or groove, for engaging with the clamp element. The clamp element may be shaped to match the contours of at least a portion of the branch element or inlet or inlet member or inlet spigot or flange or groove. The clamp element may comprise a receptacle, for example a U-shaped or C-shaped receptacle, which may have an undersized neck, e.g. to provide a snap fit with a portion of the branch element or inlet or inlet member or inlet spigot. Preferably, the clamp element comprises two receptacles each for connecting and/or securing the branch element to one of the two outlets. The clamp element may comprise one or more flanges, e.g. inwardly extending radial flanges, for cooperation with the aforesaid portion. The or at least one of the or each, radial flange may extend inwardly, for example from a respective hollow portion, which may be part cylindrical, and/or may be U-shaped or C-shaped and/or circumscribe more than half 180° and/or may include a lead-in, e.g. to facilitate insertion.

In other embodiments, the branch element or inlet or inlet member may comprise a receptacle or ring portion within which is received one or both of the outlets. The branch element or inlet or inlet member may be connectable in one of two or more orientations, for example a first orientation in which the branch element is aligned at least partially with a first of the outlets and/or a second orientation in which the branch element is aligned at least partially with a second of the outlets. The branch element may comprise locating means, such as a locating flange or recess, that may be configured to cooperate with a locating means, such as a locating recess or flange, on or of the fill valve assembly or a housing thereof or the equilibrium valve.

The assembly or branch element may comprise a non-return means or valve or a restriction means, e.g. a flow restrictor, and/or a filter and/or an outlet that may include a push fit fitting. The fill valve may comprise a float pivotally mounted with respect to the equilibrium valve, for example via a lever that may selectively close a bleed port of the equilibrium valve to selectively open and/or close the equilibrium valve.

Another aspect of the invention provides a syphon assembly for discharging water from a cistern, the assembly comprising an inverted generally U shaped duct having an upleg and a downleg, an open-ended, e.g. enlarged, chamber fluidly connected to the upleg, a piston movable in the chamber and an actuator, e.g. a power-driven actuator, operatively connected to the piston, wherein the actuator is operable to move, in use, the piston, or at least assist in the movement thereof, within the chamber to initiate a syphonic flushing action, for example under the influence of an external source of power.

The use of a power-driven actuator to operate the piston obviates the need to apply substantial force to initiate the flush.

As used herein, the term "power-driven actuator" means an actuator that is configured, in use, to be driven by, or whose operation is at least assisted by, an external source of power, such as one or more of a source pressurised fluid, an electrical power source or some other source of power. For example, the power-driven actuator may comprise a fluid-driven, or fluid pressure-driven, e.g. hydraulically-driven or pneumatically-driven, actuator and/or an electrically-driven or electro-mechanically-driven actuator.

In some embodiments, the syphon assembly comprises a flush activator in the form of a push button or lever that is operatively and/or mechanically connected to the piston, for example to raise the piston, e.g. thereby to initiate the syphonic flushing action. In such embodiments, the syphon assembly may comprise a mechanism for moving or raising the piston and/or the actuator may be configured to assist in the movement of the piston and/or may be connected, for example continuously connected, to a source, e.g. of power, such as fluid, e.g. pressurised fluid, or an electrical power source or any other source of external power.

The assembly may further comprise a piston rod with a first connector or connection means at a first end, e.g. for connecting to the piston, and/or the first end may be connected to or formed integrally with the piston. Additionally or alternatively, the piston rod may comprise a second connector or connection means at a second end, for example opposite the first end, e.g. for connecting to the actuator or to a prime mover of the actuator and/or the second end may be connected to or formed integrally with at least part of the actuator, e.g. a prime mover thereof. Preferably, the piston rod extends through the chamber, for example a wall of the cylinder, which may be an upper wall in use.

Another aspect of the invention provides a power-driven actuator, for example configured use with the syphon assembly described above, the actuator may comprise a prime mover and/or a piston rod that may be connected at a first end thereof to the prime mover, e.g. by a first connector or connection means, and/or a second connector or connection means adapted to connect, in use, to a piston, e.g. for driving the piston.

For the avoidance of doubt, any of the features described herein apply equally to any aspect of the invention.

The actuator may be driven hydraulically and/or pneumatically and/or electromechanically. The actuator may comprise a hydraulic or pneumatic or electro-mechanical actuator. The actuator may be connected or connectable to one or more of a source of pressurised fluid, e.g. a pneumatic or hydraulic fluid, an electrical power source or some other source of power.

The actuator is preferably connected or connectable, in use, to a fluid or liquid or water or air supply, for example a pressurised fluid or liquid or water or air supply, such as by a pipe or tube or hose, which may be flexible. More preferably, the actuator is a hydraulic actuator, which may be fluidly connected, in use, or connectable to a mains water supply, e.g. domestic or commercial mains water supply, e.g. to drive the operation of the actuator.

This is particularly advantageous, since domestic and indeed commercial cisterns are invariably connected to a mains water supply for filling the cistern. Thus, such a device makes use of a pre-existing feature of cisterns without the need for connection to, for example, an electric power supply.

In some embodiments, the actuator is operatively and/or fluidly connected or connectable to the or a fill valve, for example to or via a branch element thereof. The branch element may be operatively or fluidly connected or connectable or comprised or integrated in a fill valve assembly, preferably upstream of a valve or valve member thereof.

The prime mover of the actuator may comprise an actuator piston, which may comprise a piston head and/or may be reciprocable within an actuator cylinder. The actuator cylinder may comprise an inlet at or adjacent a first of its ends and/or a vent at or adjacent at a second of its ends, for example two or more, e.g. three or more, preferably four peripheral vents or slots. The actuator cylinder may further comprise a cap, for example an anti-splash cap, which may cover and/or surround the vent and/or be mounted over or adjacent thereto and/or is spaced therefrom. Preferably, the actuator piston or piston head is sized and/or dimensioned such that a fluid flow entering the cylinder from the inlet forces the piston from the first end toward the second end. More preferably, the actuator piston or piston head is sized and/or dimensioned such that fluid, e.g. some or a predetermined amount of fluid, is able to flow, e.g. at a predetermined flowrate, between the actuator piston or piston head and the cylinder, for example in the absence of a fluid flow from the inlet. More preferably, the actuator piston or piston head and the actuator cylinder vent are each configured such that the actuator provides a pre-determined actuator force.

The actuator may comprise or be connected or connectable, e.g. in use, to, and/or controlled or controllable, e.g. in use, by a control valve or control valve means or assembly. The control valve or control valve means or assembly may comprise an operating or equilibrium valve and/or a pilot or bleed valve and/or a control lever or button or proximity sensor or switch, for example a touchless or soft touch sensor or switch, one or more of which, e.g. each of which, may be operatively connected together. Preferably, the syphon assembly or the control valve or control valve means or assembly comprises a control lever or button or proximity sensor or switch that operates the pilot valve, which in turn may activate or operate or open the operating valve. More preferably, the control lever or button or proximity sensor or switch causes, e.g. on activation thereof, the bleed valve to open, which may release pressure from the equilibrium valve, for example a pressure chamber thereof, e.g. thereby opening the equilibrium valve. The connection between the pressure chamber and the pilot or bleed valve may be provided by a tube, for example a hydraulic tube.

The operating or equilibrium valve may be mounted to or adjacent to or otherwise associated with the syphon assembly or chamber or actuator and/or the pilot or bleed valve and/or a control lever or button or proximity sensor or switch. Alternatively, the operating or equilibrium valve may be mounted remotely with respect to the syphon assembly or chamber or actuator and/or the pilot or bleed valve and/or a control lever or button or proximity sensor or switch. In preferred embodiments, the pilot or bleed valve and/or a control lever or button or proximity sensor or switch is mounted or located remotely with respect to the syphon assembly or chamber or actuator, for example on an external and/or exposed surface of a cistern or toilet or water closet furniture or wall with or within which the syphon assembly is associated or comprised or incorporated. In such embodiments, the operating or equilibrium valve may be mounted to or adjacent to or otherwise associated with the syphon assembly or chamber or actuator or mounted remotely with respect thereto and/or adjacent to or remotely with respect to the pilot or bleed valve and/or control lever or button or proximity sensor or switch.

Activation or operation or opening of the operating valve or equilibrium valve preferably allows or permits fluid to drive the actuator, for example the prime mover or piston thereof, e.g. to move the piston rod, for example to move the piston within the chamber to initiate a syphonic flushing action. The control lever or button or proximity sensor or switch preferably comprises or is incorporated within an activator or flush activator or push button or an integrated activator or flush activator or push button, which may be configured to provide partial flush and/or dual flush functionality, for example the activator or flush activator or push button may allow either full or partial flush actuation or activation. In some embodiments, a partial flush is initiated by activating or pressing and holding the push button, while a full flush is initiated by activating or pressing and releasing the push button, or vice versa.

In some embodiments, the activator or flush activator comprises a valve means operatively connected or connectable to the or an equilibrium valve, for example a bleed port of the or an equilibrium valve, e.g. for selectively opening and/or closing, or wherein the equilibrium valve is configured or adapted to selectively open and/or close, fluid communication between the actuator and the or a source of fluid or pressurised fluid. The activator or flush activator may additionally or alternatively comprise an actuator, e.g. for operating the valve means. In some embodiments, the activator or flush activator comprises an inlet, which may be operatively or fluidly connected or connectable to a bleed port of the equilibrium valve, and/or an outlet, which may open to or into, and/or be configured or arranged to feed into, a cistern to which the siphon assembly is incorporate or connected in use.

Another aspect of the invention comprises a control valve assembly, e.g. for operating or controlling a flushing system or assembly or syphon assembly, for example as described above, the control valve assembly comprising an operating or equilibrium valve, e.g. fluidly connected or connectable to the or a syphon assembly, and/or a activator or flush activator, which may comprise an outset and/or an inlet. The activator or flush activator or the outlet thereof may be operatively connected to the operating or equilibrium valve or to a bleed port thereof. The activator or flush activator may be operable to open, in use, fluid communication between the inlet and the outlet, e.g. thereby causing the equilibrium valve to open, for example to supply fluid, e.g. under pressure, to the syphon assembly or actuator thereof and/or to drive the syphon assembly or actuator to initiate a syphonic flushing action.

The operating or equilibrium valve may be fluidly connected or connectable to a flushing system or assembly. The activator or flush activator may be operable to open, in use, fluid communication between the inlet and the outlet, thereby causing the operating or equilibrium valve to open and supply fluid. e.g. under pressure, to the flushing system or assembly to initiate a flushing action.

Yet another aspect of the invention provides a activator or flush activator, e.g. for use in or with a control valve assembly or syphon assembly as described above, the activator comprising an outlet and/or an inlet, e.g. for fluidly connecting to an equilibrium valve or to a bleed port thereof, and/or an actuator and/or a valve member that may be operatively connected to the actuator and/or that may extend between the inlet and the outlet, wherein the actuator is operable to move, in use the valve member from a first position, for example in which fluid communication between the inlet and the outlet is prevented or inhibited, e.g. thereby causing the equilibrium valve to be in or move to a closed position or condition, to a second position, for example in which the inlet is in fluid communication with the outlet, e.g. thereby causing the equilibrium valve to open or to be in or move to an open position or condition.

The valve member may comprise a sealing means, for example an O-ring seal that may be received or receivable within a circumferential groove thereof, at one or each of its ends, for example wherein the or one of the sealing means is moved out of engagement with a passageway within which the valve member is at least partially received, e.g. when moved from the first position to the second position. The activator or flush activator may comprise a biasing means, for example a resilient biasing means such as a spring which may comprise compression spring, for or configured to bias the valve member toward the first position. The actuator may comprise a push button and/or may be connected or fixed to or with respect to e.g. threadedly connected or engaged to the valve member.

The assembly may comprise a partial flush means. The partial flush means may comprise a passage opening the syphon chamber to the interior of the cistern in use, which passage may be open when the piston is in an actuated or raised position or condition and/or closed when the piston is in a rest or lowermost position or condition or vice versa. The chamber may comprise the passage, which may at least partially surround the piston rod and/or may be closed by a sealing means or seal associated with the piston rod, for example as described in GB2329398. The sealing means may be biased to or toward a closed position or condition, for example in which the passage is closed. The assembly may be configured such that the sealing means is moved from the closed position or condition to an open position or condition only when the piston is at or adjacent a fully raised or uppermost position, e.g. such that a maximum volume flush can be effected by raising the piston and allowing it to drop to an intermediate position, for example below its fully raised or uppermost position, without delay, but a lesser volume flush can only be effected by holding the piston in a substantially fully raised or uppermost position until the water level drops below the passage opening allowing air to enter the chamber and interrupting the syphonic action Another aspect of the invention provides a syphon assembly for discharging water from a cistern, the assembly comprising an inverted generally U shaped duct having an upleg and a downleg, an open-ended, e.g. enlarged, chamber fluidly connected to the upleg, a piston movable in the chamber for initiating a flushing action, a passage extending from the interior of the chamber to the interior of a cistern in use at a position that is higher than the open end of the chamber and a sealing means biased to a closed position or condition in which the passage is closed, wherein the assembly is configured such that the sealing means is moved from the closed position or condition to an open position or condition only when the piston is at or adjacent a fully raised or uppermost position, e.g. such that a maximum volume flush can be effected by raising the piston and allowing it to drop to an intermediate position, for example below its fully raised or uppermost position, without delay, but a lesser volume flush can only be effected by holding the piston in a substantially fully raised or uppermost position until the water level drops below the passage opening allowing air to enter the chamber and interrupting the syphonic action.

The sealing means may comprise a seal, e.g. a sealing washer, which may be biased or resiliently biased, for example by a biasing means or resiliently biasing means such as a spring which may be a compression spring. The sealing means may be biased or resiliently biased toward or against the chamber or passage or toward a closed or sealing position or condition. The passage may comprise an annular passage or vent, which may be interrupted. The or a piston rod or a lower portion thereof or the syphon piston may comprise an abutment surface or element or member, which may be configured to abut and/or unseat or move the sealing means, e.g. from the closed position or condition to the open position or condition. The sealing means may include an abutment surface or element or member that may be connected or mounted or fixed to the seal or sealing washer or formed integrally therewith.

Additionally or alternatively, the piston rod may comprise the passage. Additionally or alternatively, the passage may be defined between the piston rod and the opening through which the piston rod passes, for example by an undersized portion of the rod along part of its length or one or more depressions on an outer surface of the piston rod or through its centre.

The piston or syphon piston may comprise a plate or plate member or flat member and/or may incorporate one or more apertures or holes or openings, and/or a diaphragm, for example a flexible diaphragm that may be formed of a flexible e.g. elastic and/or plastics, material, which may be a sheet material. The diaphragm may coextend and/or may be secured, e.g. at its centre, to the plate or plate member or flat member, for example to on one of the major sides thereof. The assembly may further comprise a biaser or biasing means for biasing the piston or plate or plate member or flat member toward the open end of the chamber. The biasing means may comprise a weight that may be mounted, e.g. releasably or movably mounted, to the piston or plate or plate member or flat member. Additionally or alternatively, the biasing means may comprise a resilient biasing means, such as a spring, e.g. a compression spring, that may, for example, provide an urging force.

The actuator may be connected to the mains water supply or inlet valve or branch element or control valve or control valve means or assembly or operating or operating valve by a hose, for example a flexible hose. The connection between the actuator and the mains water supply or inlet valve or branch element or control valve or control valve means or assembly or operating or operating valve is preferably at the inlet of the actuator. The inlet of the actuator may be at or in a lower portion of the actuator and/or below the actuator piston or piston head in use, e.g. so that when water enters the cylinder portion it is forced upwards along with the piston in order to initiate a flush.

In use, operation of the control lever or button or proximity sensor or switch may activate the pilot or bleed valve or cause it to open, which may cause water to bleed from the pressure chamber of the equilibrium valve, e.g. through the tube and into the cistern. A subsequent reduction in the pressure in the equilibrium valve, e.g. in the internal pressure chamber thereof, may result in the equilibrium valve opening, for example allowing water to flow into the piston chamber, driving the piston and plate member up to start the syphonic effect. Removal of the activation of, or force on, the control lever or button or proximity sensor or switch may cause the equilibrium valve to close and/or the biasing means to cause the plate or plate member or flat member to return to a pre-flush position or condition. As the piston returns to its pre-flush position or condition, water in the piston cylinder may bleed out around the actuator piston or piston head.

The syphon assembly may comprise an adjustment means for adjusting the configuration of the syphon in the manner described in GB2486776, the entire contents of which are incorporated herein by reference. The syphon may further comprise an adaptable full flush volume feature, which may be similar to the arrangement disclosed in GB2338723, the entire contents of which are incorporated herein by reference. Alternatively, the syphon may comprise an adaptable full flush volume feature that is adjustable with the syphon in situ. For example the syphon assembly may comprise a closure element for selectively changing the full flush volume or the level at which syphonic action is interrupted, which closure element may be removable when the syphon assembly is mounted, in use, within a cistern.

Another aspect of the invention provides a syphon assembly for discharging water from a cistern, the assembly comprising an inverted generally U shaped duct having an upleg and a downleg, an open-ended, e.g. enlarged, chamber fluidly connected to the upleg, a piston movable in the chamber for initiating a syphonic flushing action and a closure element mounted, e.g. removably and/or slidably mounted, to a side wall of the chamber to cover an aperture therein, wherein the closure element is removable from above when the syphon assembly is mounted, in use, within a cistern.

The closure element may be received, for example slidingly or slidably received, within a slot or guide in or on or associated with the chamber or the side wall thereof. Preferably, the closure element is slidable along, e.g. vertically along, the chamber or side wall such that it may be removed from above. The closure element may comprise a stop or stop element, such as a flange, which may be comprised or incorporated in or mounted on an upper portion of the closure element, for example which flange may abut, e.g. in use, a portion or surface, e.g. an upper portion or surface, of the slot or guide or chamber or side wall. The closure element may additionally or alternatively comprise one or more, e.g. two or more, preferably three or more, such as four or five or more, openings or apertures or holes each of which may correspond to or define a different full flush volume or water level at which syphonic action is or would be interrupted. One or more or each of the openings or apertures or holes may comprise a closure or plug that may be received, e.g. removably received, therein and/or secured thereto or with respect thereto, for example to close the opening or aperture or hole.

The syphon assembly or chamber may comprise one or more, preferably two or more, such as three or four or five or more, e.g. a plurality of, ribs, which may be horizontal. The slot or guide may be at least partially provided by or incorporated within the or at least one of the or each of the ribs. The or at least one of the or each of the ribs may extend horizontally and/or include a cutout that at least partially defines the slot or guide. The Or each cutout may include an enlarged portion, e.g. central portion, for example to permit the closure or plug or closures or plugs of the closure element to pass therethrough.

The syphon assembly may be constructed from any suitable material or combination of materials. Preferably, the toilet flushing means is constructed from a corrosion-resistant material, for example a plastics material, or a corrosion resistant metal such as copper.

A more general aspect of the invention provides a draining apparatus for discharging water from a cistern, the apparatus comprising an inlet member, an outlet member fluidly connected to an inlet of the inlet member by a conduit, and a piston assembly connectable to a mains water supply, wherein, in use, the piston assembly can be actuated by mains pressure water, thereby causing flow of water through the inlet and discharging water from the cistern.

A further aspect of the invention provide a kit of parts for assembly into an assembly as described above and/or a retrofit kit for adapting an existing syphon assembly to provide an assembly as described above and/or a cistern comprising a syphon assembly and/or any one or more assemblies or components described above. A yet further aspect of the invention provides a method of discharging water from a cistern, for example using a syphon assembly described above, the method comprising one or more of the steps described above or that the skilled person would understand to be advantageous.

Embodiments of the invention will now be described by way of example only with reference to the accompanying drawings in which.

Figure 1:
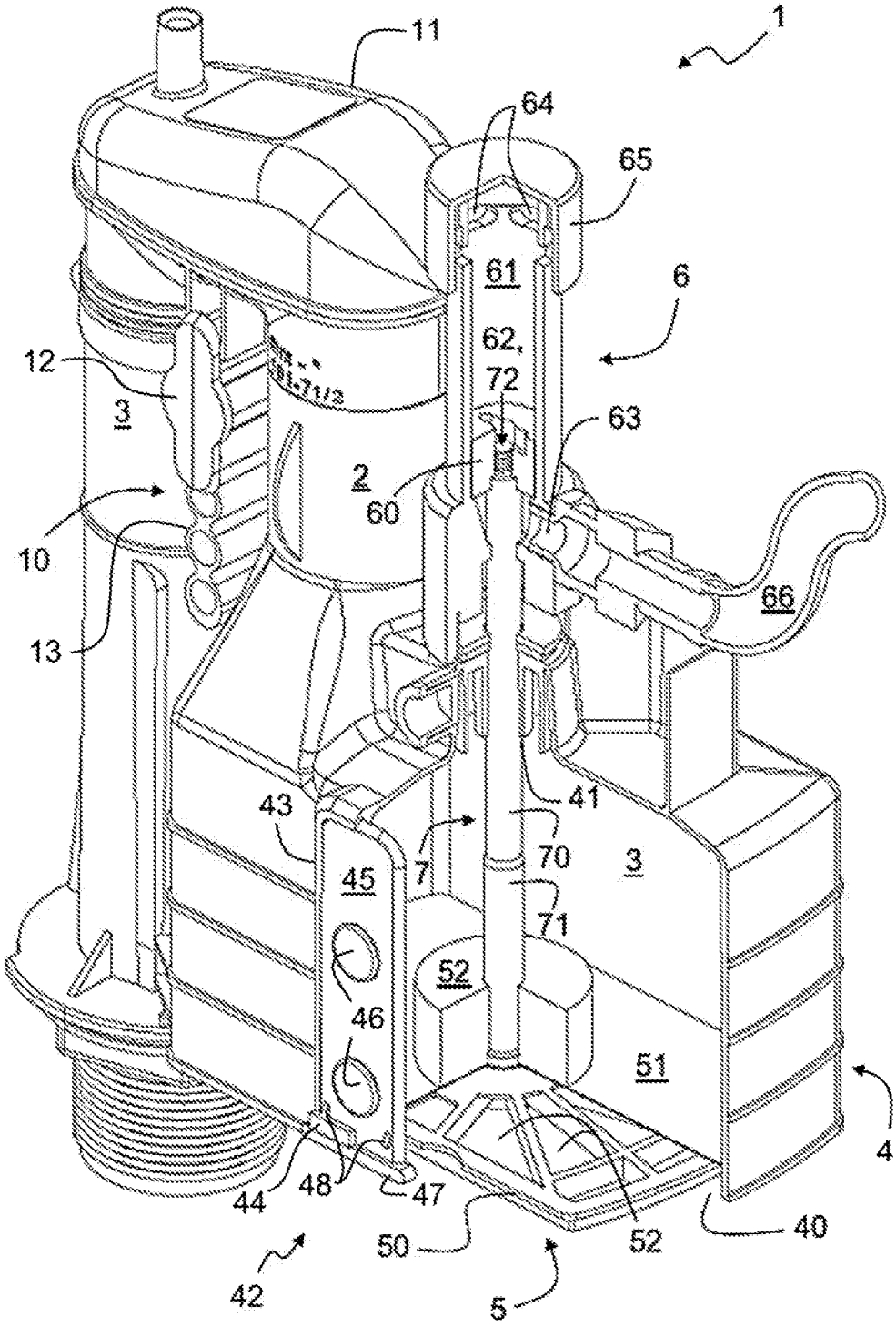
FIG. 1 is a partially segmented perspective view of a syphon assembly according a first embodiment to the present invention.
Figure 2:
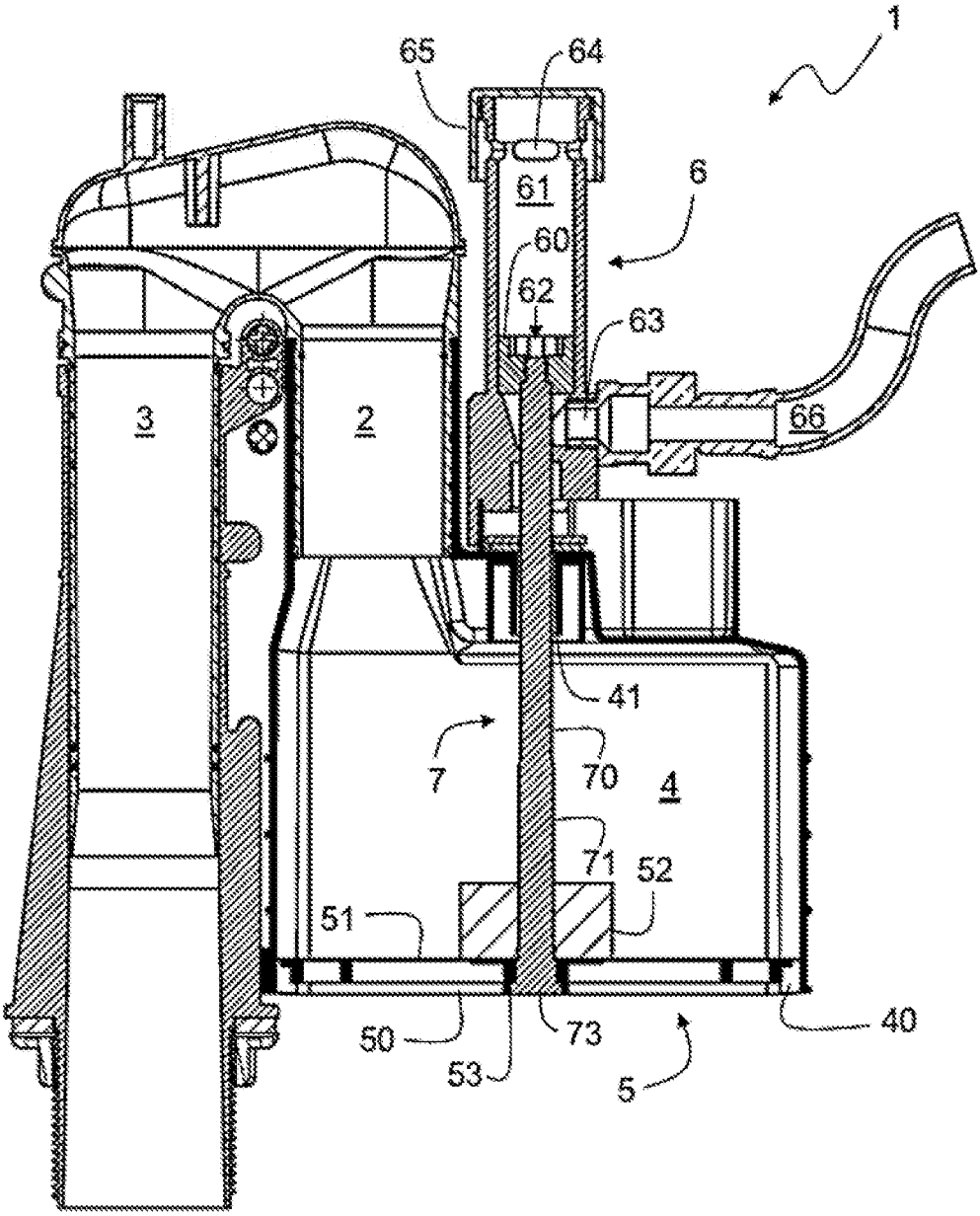
FIG. 2 is a cross sectional side view of the syphon assembly of FIG. 1.

Referring to FIGS. 1 and 2 there is shown a syphon assembly 1 for discharging water from a cistern (not shown). In this embodiment, the syphon assembly 1 includes an adjustment means 10 for adjusting the configuration of the syphon. The syphon assembly 1 includes an inverted generally U shaped duct 11 fluidly and telescopically connected to an upleg 2 and a downleg 3, an enlarged rectangular chamber 4 integral with the upleg 2 and having an open lower end 40, a piston 5 movable in the chamber 4 and a hydraulic actuator 6 connected to the piston 5 by a piston rod 7 that extends through a hole 41 in an upper wall of the chamber 4. The downleg 3 is connected, in use, to the flush pipe of a cistern (not shown) to feed flush water into a toilet pan (not shown). The hydraulic actuator 6 is operable to move the piston 5 within the chamber 4 to initiate a syphonic flushing action in use.

The adjustment means 10 is provided by a releasable fastener 12 that secures the U shaped duct 11, the upleg 2 and the downleg 3 together by engaging simultaneously a respective chain of lugs 13 in the manner described in GB2486776.

In this embodiment, the chamber 4 includes an adaptable flush volume feature 42 similar to the arrangement disclosed in GB2338723. More specifically, one of the wider, side walls of the chamber 4 is provided with a vertically extending venting aperture in the form of a generally rectangular slot 43 closed at its upper end, open at its lower end and having a raised bridging portion 44 across the lower end. The slot 43 also includes an edge profile that slidably receives and releasably and sealingly engages a correspondingly shaped closure element 45. The closure element 45 includes two removable plugs 46 for varying the flush volume, a lower flange 47 and a pair of locking lugs 48. The closure element 45 is inserted into and/or removed from the slot 43 through the open lower end and is secured in place by captivating the bridging portion 44 of the chamber 4 between the flange 47 and locking lugs 48.

The piston 5 includes a plate 50 with a coextensive diaphragm 51 and a weight 52 each of which is secured at its centre to the centre of the upper major surface of the plate 50. The plate 50 is formed of a rigid or semi-rigid plastics material in this embodiment and incorporates a plurality of apertures 52 through its thickness and a central engaging hole 53 with a counterbore on the opposite side of the piston 5 to the diaphragm 51 and weight 52. The diaphragm 51 is formed of a sheet of flexible plastics material in this embodiment such that a flow of water from beneath the piston 5 through the apertures 52 causes the diaphragm 51 to raise and allow water to flow, but prevents flow in the opposite direction, thereby operating as a one-way valve.

The actuator 6 includes an actuator piston 60 reciprocable within an actuator cylinder 61. The actuator piston 60 includes a threaded hole 62 for securement with an upper end of the piston rod 7 and the piston rod 7 extends through a first end of the actuator cylinder 61. The actuator cylinder 61 includes a radial inlet 63 adjacent its first end and four peripheral vents or slots 64 adjacent a second end thereof. The actuator cylinder 61 also includes an anti-splash cap 65, which covers the second end and surrounds the peripheral vents or slots 64, but is spaced therefrom to provide a gap for water and/or air to pass. The inlet 63 is connected to an equilibrium valve (not shown) by a flexible hose 66.

In this embodiment, the actuator piston 60 is sized and dimensioned such that a fluid flow entering the actuator cylinder 61 from the inlet 63 forces the actuator piston 60 from the first end of the actuator cylinder 61 toward the second end thereof. The actuator piston 60 is also sized and dimensioned such that the clearance between the actuator piston 60 and the cylinder 61 permits some fluid to flow therebetween. In this embodiment, the piston 60 is formed of a plastics material having a relatively low weight.

The piston rod 7 is substantially cylindrical in shape with an undersized first portion 70, which is an upper portion in this embodiment, and a second portion 71, which is a lower portion in this embodiment. In this embodiment, the first portion 70 is sized and dimensioned to provide clearance between the hole 41 in the chamber 4 to allow air to pass therebetween, while the second portion 71 is sized and dimensioned to prevent the passage of air when received within the hole 41. The piston rod 7 also includes a threaded end 72 at the end of the first portion 70 and an engaging head 73 at the end of the second portion 71. The threaded end 72 is received within and engages the threaded hole 62 of the actuator piston 60 to secure the piston rod 7 to the actuator piston 60. The engaging head 73 is an enlarged portion that is received within the correspondingly shaped engaging hole 53 of the piston plate 50.

Figures 3, 4, 5, 6:
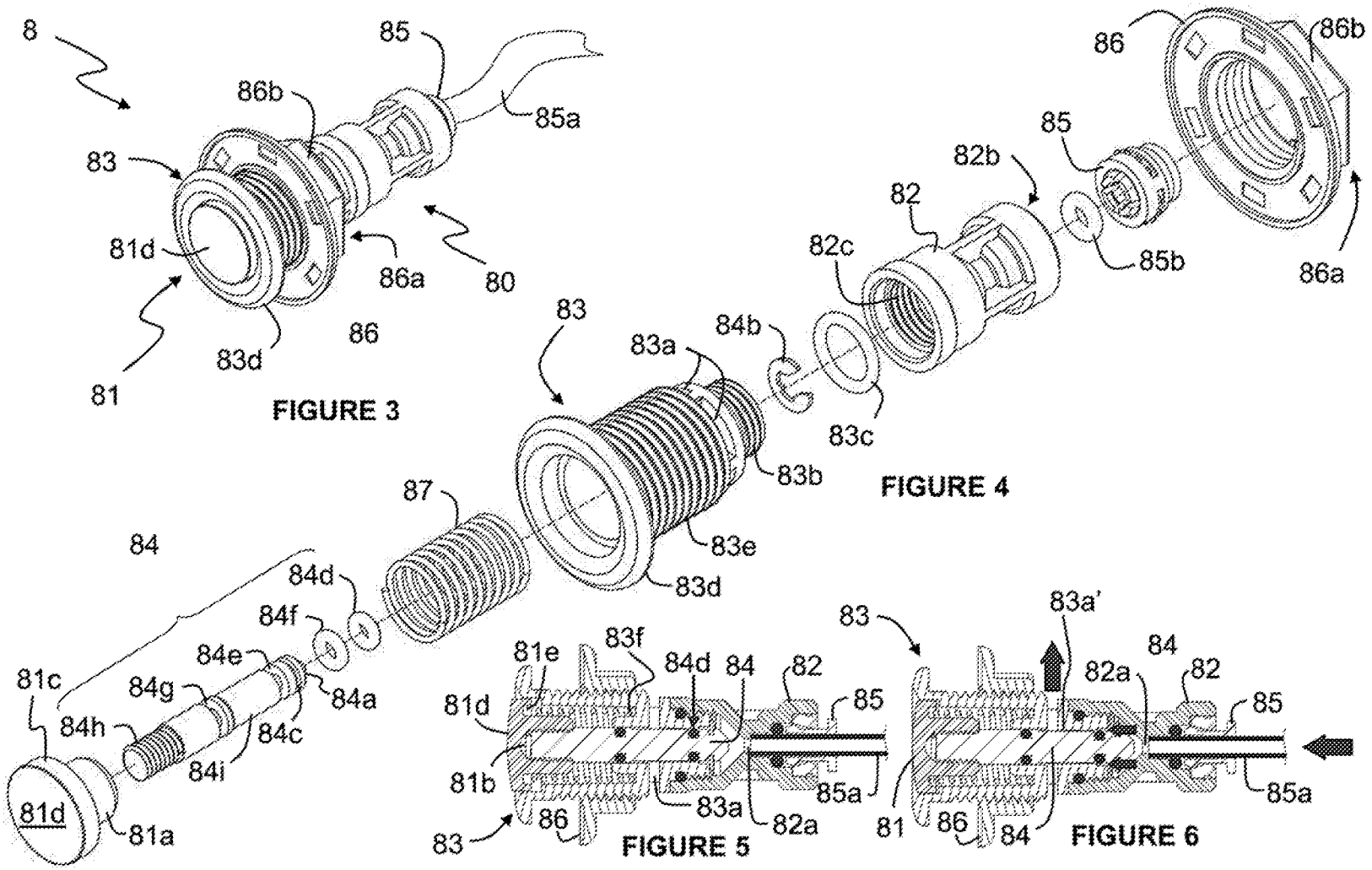
FIG. 3 is a perspective view of the flush activator for use with the syphon assembly of FIGS. 1 and 2.
FIG. 4 is an exploded view of the flush activator of FIG. 3.
FIG. 5 is a cross-sectional view of the flush activator of FIGS. 3 and 4 shown in an unactuated condition.
FIG. 6 is a view similar to that of FIG. 5 with the flush activator shown in an actuated condition.
Figure 7:
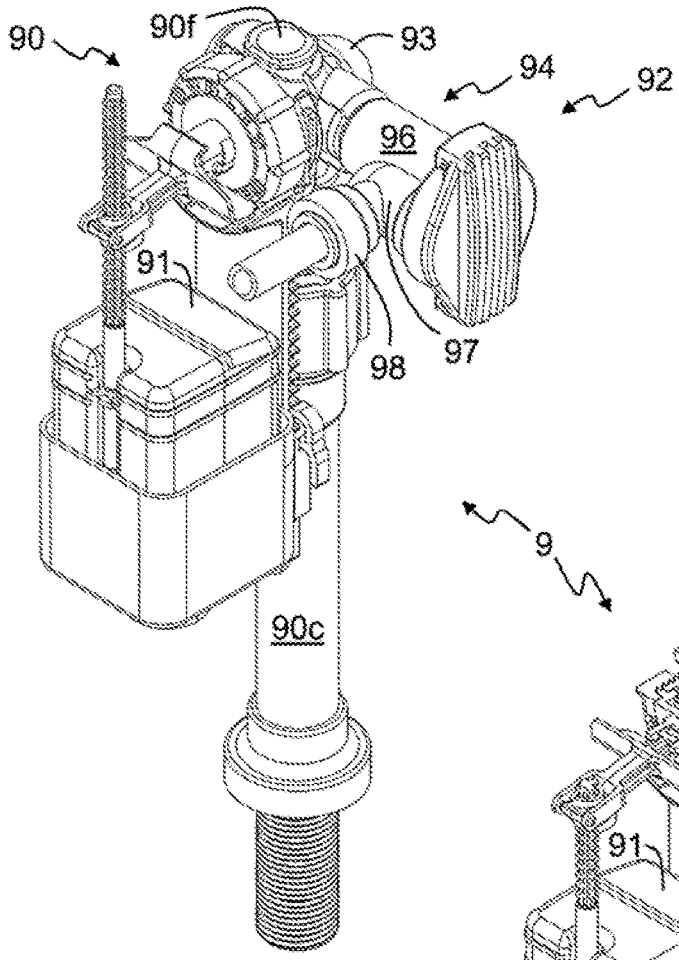
FIG. 7 is a perspective view of a bottom entry fill valve assembly incorporating a branch element for use with the syphon assembly of FIGS. 1 and 2.
Figure 8:
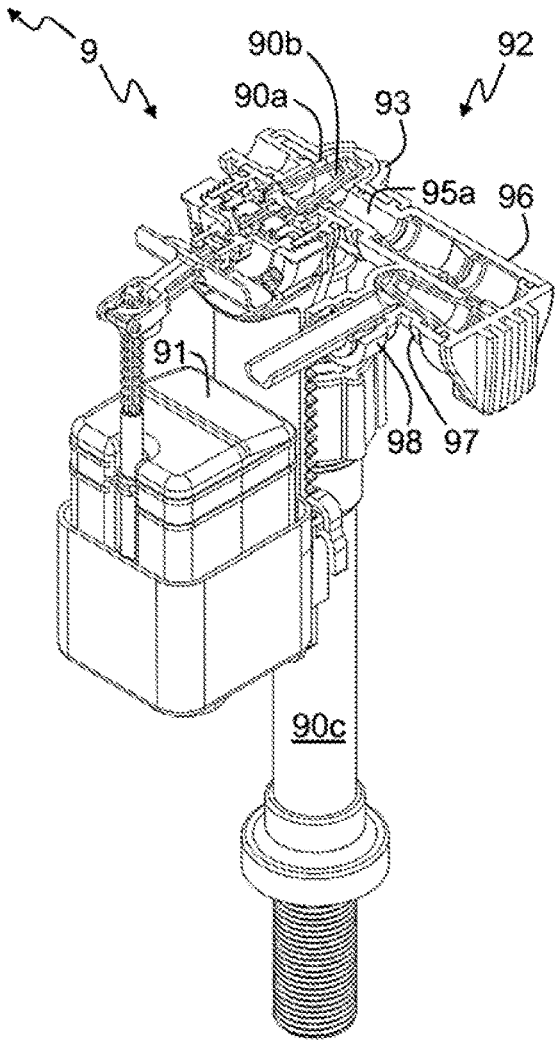
FIG. 8 is a perspective view of the fill valve assembly of FIG. 7 sectioned through the fill valve and branch element.
Figure 9:
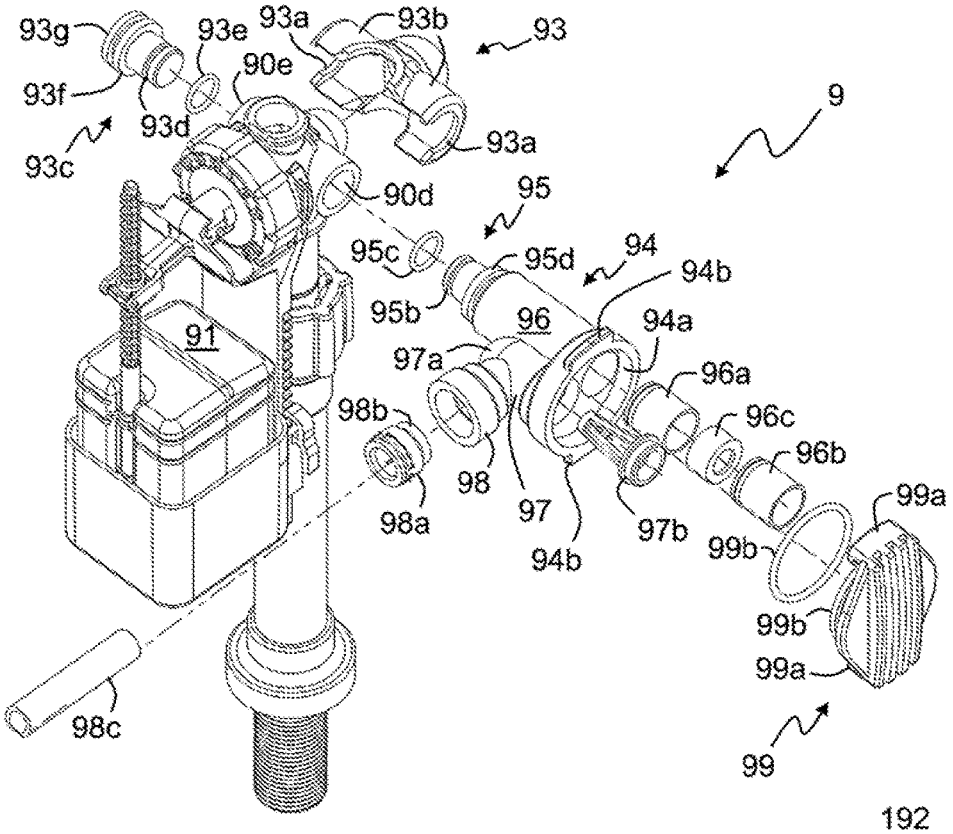
FIG. 9 is a partially exploded view of the fill valve assembly of FIGS. 7 and 8.
Figure 10:
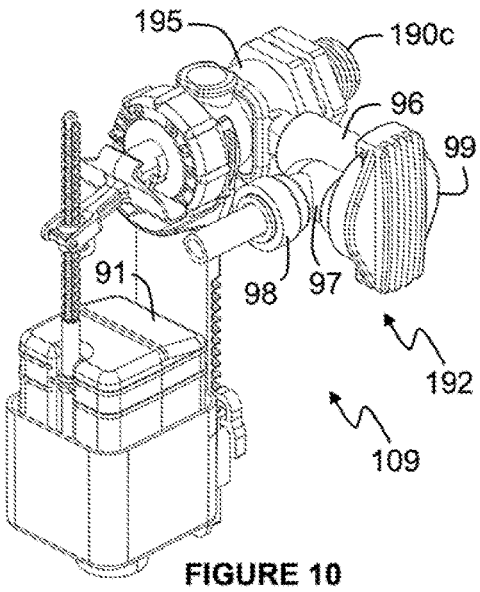
FIG. 10 is a perspective view of a side entry fill valve assembly with a branch element in a first orientation for use with the syphon assembly of FIGS. 1 and 2.
Figure 11:
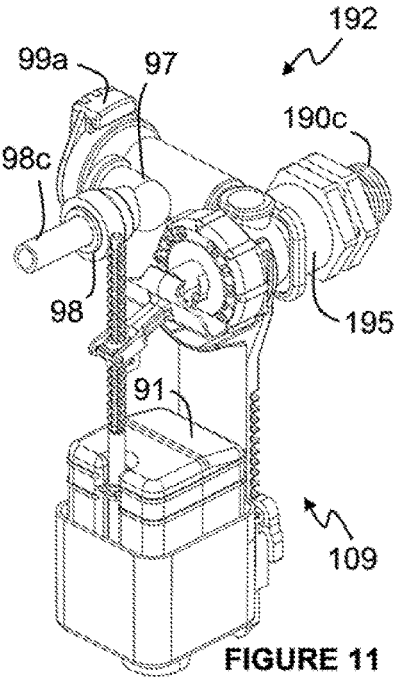
FIG. 11 is a perspective view of the fill valve assembly of FIG. 10 with the branch element in a second orientation.
Figure 12:
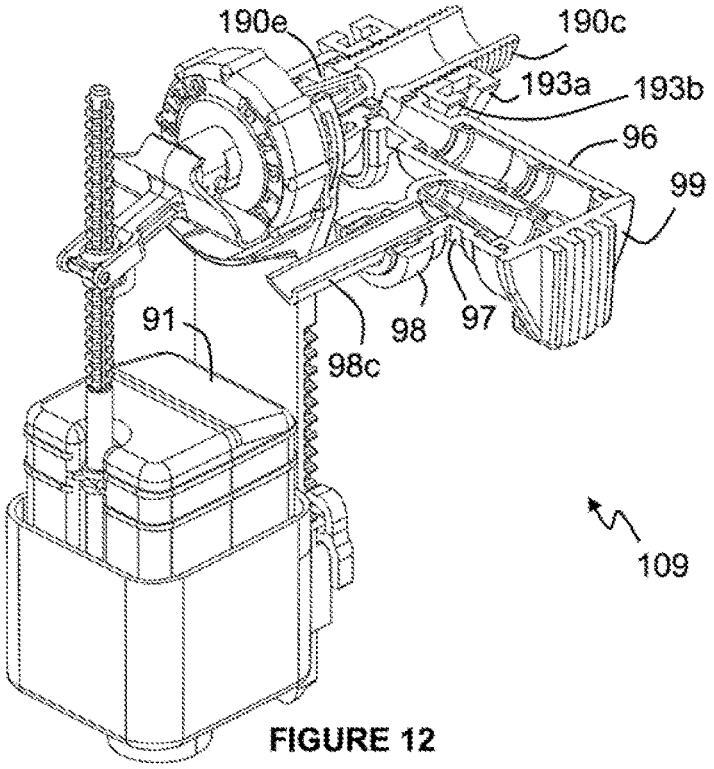
FIG. 12 is a perspective view of the fill valve assembly of FIG. 10 sectioned through the fill valve and branch element.
Figure 13:
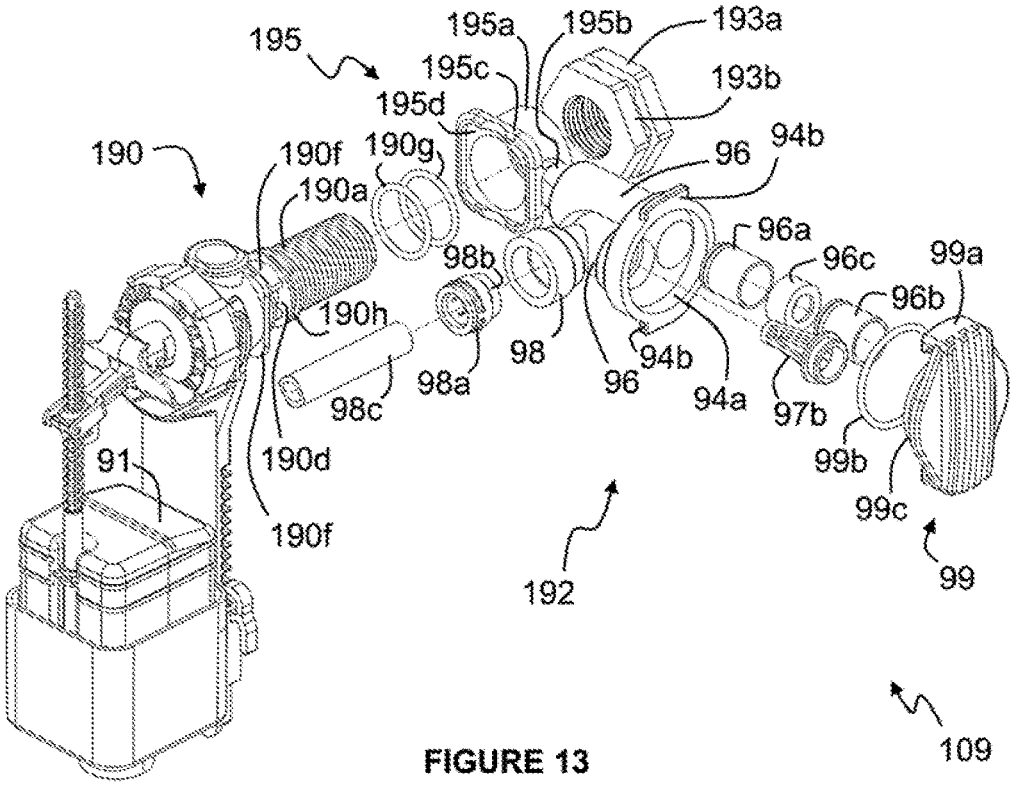
FIG. 13 is a partially exploded view of the fill valve assembly of FIG. 10.

The supply of mains water is controlled by a control assembly that includes the equilibrium valve (not shown), which is fluidly connected to a flush activator 8 that incorporates a bleed valve 80 operated by an integral a pushbutton 81 (shown in FIGS. 3 to 5). The bleed valve 80 includes an inlet housing 82, an outlet housing 83 and a valve member 84. The flush activator 8 also includes a push fit fitting 85 for securely receiving a tube 85*a*, a compression spring 87 and a circular mounting flange 86 with an internally threaded hollow body 86*a* with a hexagonal circumference 86*b*.

The pushbutton 81 includes a body 81*a* with an internally threaded blind hole 81*b* extending from a first end thereof and an enlarged head 81*c* at a second end thereof. The head 81*c* includes a convex actuation surface 81*d* on a first side thereof and an annular recess 81*e* on a second side thereof.

The inlet housing 82 is hollow and substantially cylindrical with a longitudinal bore that narrows at its centre to provide an inlet port 82*a*. The push fit fitting 85 is securedly received within a first end 82*b* of the inlet housing 82 by an interference fit with an O-ring seal 85*b* captivated between the push fit fitting 85 and an adjacent internal surface of the inlet housing 82. The inlet housing 82 also includes an internally threaded second end 82*c*.

The outlet housing 83 is also hollow and substantially cylindrical with four radial outlets 83*a* fluidly connected to and extending from a longitudinal bore 83*a*', which receives and guides the valve member 84. The outlet housing 83 includes an undersized, externally threaded first end 83*b* for threaded engagement with the second end 82*c* of the inlet housing 82 and an O-ring seal 83*c* received within a circumferential groove to provide a sealing engagement therebetween. The outlet housing 83 also includes a flange 83*d* at a second end thereof and an external thread 83*e* between the outlets 83*a* and the flange 83*d* for engagement with the mounting flange 86 in order to captivate a wall portion (not shown) of a cistern (not shown) or water closet furniture (not shown) therebetween in the normal way.

The valve member 84 includes a first, tapered end 84*a*, a snap ring 84*b* received within a first circumferential groove 84*c* adjacent the first end 84*a*, a first O-ring seal 84*d* received within a second circumferential groove 84*e*, a second O-ring seal 84*f* received within a third circumferential groove 84*g* and a second, externally threaded end 84*h* for engagement with the blind hole 81*d* of the pushbutton 81. The valve member 84 also includes a circumferential undercut 84*i* between the O-ring seals 84*d*, 84*f*.

As shown more clearly in FIG. 5, the compression spring 87 is located around the valve member 84 and pushbutton body 81*a* with one of its ends received within the annular 81*e* of the pushbutton 81. The compression spring 87 is captivated between the pushbutton head 81*c* and an internal annular recess 83*f* of the outlet housing 83 and biases the valve member 84 toward a closed position in which the snap ring 84*b* abuts the first end 83*b* of the outlet housing 83. With the valve member 84 in the closed position, the first O-ring seal 84*d* seals against the bore 83*a*' of the outlet housing 83 to close fluid communication between the inlet port 82*a* and the outlets 83*a*.

Depression of the pushbutton 81 moves the valve member 84 from the position illustrated in FIG. 5 to that shown in FIG. 6, which moves the O-ring seal 84*d* out of engagement with the bore 83*a*', thereby allowing pressurised water from the bleed port of the equilibrium valve (not shown) to exit through the outlets 83*a* via the undercut 84*i*. This releases pressure from a pressure chamber of the equilibrium valve (not shown), thereby opening the equilibrium valve (not shown).

The equilibrium valve (now shown) in this embodiment mounted remotely from the syphon assembly 1 and is fluidly connected to a domestic mains water system (not shown) via a fill valve assembly 9, 109 to selectively provide a flow of water at mains pressure to the actuator cylinder 61 through the inlet 63. The use of a bottom entry fill valve assembly 9 or a side entry fill valve assembly 109 depends upon the cistern (not shown) into which the syphon assembly 1 is incorporated in use.

As shown in 7 to 9, the bottom entry fill valve assembly 9 includes a float controlled diaphragm valve 90 of the kind described in GB2332731, the contents of which are incorporated herein by reference, in which water pressure on opposite sides of the diaphragm is kept substantially in equilibrium so that when a lever mounted float 91 drops, a bleed aperture is exposed and unseats the diaphragm by a small change in pressure differential. The fill valve assembly 9 according to this embodiment differs from the aforementioned design in that there is provided a branch element 92 that cooperates with the valve 90 to feed the actuator 6 of the syphon assembly 1. Specifically, the filter chamber 90*a* that houses the conical inlet filter 90*b* of the valve 90, which is fed by the vertical feed pipe 90*c*, includes a pair of side openings 90*d*, 90*e* in addition to the upper outlet 90*f* extending horizontally from the filter chamber 90*a*, wherein the branch element 92 is receivable in either one of the openings 90*d*, 90*e* and secured to the valve 90 by a clamp element 93.

The branch element 92 in this embodiment includes a twin barrel housing 94 with an open end 94*a*, a first side that includes an undersized inlet spigot 95 opposite the open end 94*a* and feeding into an inlet chamber 96 and a second side that includes a filter chamber 97 feeding into a radial outlet 98 extending perpendicularly from the filter chamber 97. The inlet spigot 95 includes an inlet passage 95*a* that feeds into a the inlet chamber 96, which is open at the open end 94*a* of the housing 94. The filter chamber 97 is also open at the open end 94*a* of the housing 94. The branch element further includes a closure element 99 for closing the open end 94*a* of the housing 94, which has a facing internal surface shaped to provide fluid communication between the open ends of the inlet chamber 96 and the filter chamber 97.

The inlet spigot 95 includes an outer circumferential groove 95*b* that receives an O-ring seal 95*c* and an external circumferential securing flange 95*d*. The inlet chamber 96 receives pair of non-return valves 96*a*, 96*b* to prevent backflow and having respective O-ring seals, the non-return valves 96*a*, 96*b* being separated by a spacer 96*c* received and captivated therebetween to enable independent operation.

The filter chamber 97 extends parallel with respect to the inlet chamber 96 and is also open at the same end of the housing 94, but it includes a hemispherical base 97*a* and feeds into the outlet 98 radially. The filter chamber 97 houses a conical inlet filter 97*b*.

The outlet 98 is hollow and substantially cylindrical in shape with two steps, providing three internal diameters, wherein a push fit fitting 98*a* is received within the largest diameter, free end of the outlet portion 98 and abuts one of the steps, while an O-ring seal 98*b* is received within the intermediate diameter and abuts a second of the steps for sealing with a tube 98*c* that is received within the smallest diameter and feeds the inlet of the equilibrium valve (not shown).

The closure element 99 includes a pair of inwardly extending flanges 99*a* that cooperate with a pair of opposed external flanges 94*b* projecting outwardly from the open end 94*a* of the housing 94 to secure the closure element 99 to the housing 94 and to seal the open end 94*a* thereof. The closure element 99 also includes an O-ring seal 99*b* received within a circumferential groove of a spigot portion 99*c* thereof, which O-ring seal 99*b* sealingly cooperates with an internal surface of the second end of the housing 94.

The clamp element 93 is shaped to match the contours of the portion of the valve 90 that houses the valve filter chamber 90*a*, but also includes inwardly extending radial flanges 93*a* adjacent the openings 90*d*, 90*e* for cooperation with the securing flange 95*d* of the inlet spigot 95. Each radial flange 93*a* extends inwardly from a respective hollow, part cylindrical portion 93*b* of the clamp element 93, circumscribes more than 180° to provide a C-shaped receptacle and includes a lead-in to facilitate insertion. In use, one of the C-shaped receptacles receives by a snap fit the portion of the inlet spigot 95 between the securing flange 95*d* and the outer surface of the inlet chamber 96 of the housing 94 such that the flange 93*a* is captivated therebetween.

The branch element 92 in this embodiment is reversible in that it may be inserted into either of the valve openings 90*d*, 90*e* depending upon the space constraints within the cistern (not shown). The fill valve assembly 9 also includes a plug 93*c* for closing off the unused opening 90*d*, 90*e*, which cooperates with the other of the C-shaped receptacles of the clamp element 93. The plug 93*c* includes similar features to the spigot portion 95, namely an outer circumferential groove 93*d* that receives an O-ring seal 93*e*, an external circumferential securing flange 93*f* and an oversized head 93*g* between which flange 93*f* and head 93*g* is received the other flange 93*a* of the clamp element 93 to seal off the other of the valve openings 90*d*, 90*e*.

Turning now to FIGS. 10 to 13, the side entry fill valve assembly 109 is similar to the bottom entry fill valve assembly 9, wherein like references depict like features that will not be described further. The side entry fill valve assembly 109 differs from the bottom entry fill valve assembly 9 in that the vertical feed pipe 90*c* is replaced with a threaded extension 190*c* of the filter chamber housing 190*a*, the side openings 190*d*, 190*e* thereof are recessed within the valve 190 and are in fluid communication with one another via an annular recess 190*f* and the inlet spigot 95 is replaced with an annular inlet member 195 of the branch element 192. The valve 190 also includes a pair of O-rings 190*g* each received within a respective groove 190*h* on either side of the annular recess 190*f*.

The annular inlet member 195 includes a cylindrical body 195*a* with a radial passageway 195*b* that feeds into the inlet chamber 96 and a square flange 195*c* with a square shaped recess 195*d* for receiving a correspondingly shaped locating flange 190*f* of the valve 190. The side entry fill valve assembly 109 also includes a pair of locking nuts 193*a*, 193*b* for securing the annular inlet member 195 to the valve 190 such that it is aligned with the side openings 190*d*, 190*e*. The branch element 192 in this embodiment is also reversible by rotating it through 180 degrees prior to locating the flange 190*f* of the valve 190*a* into the recess 195*d* of the branch element 195 and securing them together with the locking nuts 193*a*, 193*b*.

In use, when a user depresses the pushbutton 81, the equilibrium valve (not shown) opens, fluid flows into the cylinder 61 through the inlet 63, driving the actuator piston 60 upward, pulling the piston rod 7 to drive the piston 5 upward within the chamber 4 to initiate a syphonic flushing action. In this embodiment, a full flush may be initiated by pressing and holding the push button 81 so that the equilibrium valve (not shown) stays open, thereby ensuring that the second, lower portion 71 of the piston rod 7 closes the hole 41 in the chamber 4. The flushing action continues until the water level reaches the base of the chamber 4, at which point the syphonic effect is broken and the cistern (not shown) refills in the known manner by the float operated fill valve 9, 109. A partial flush may be initiated by pressing and releasing the push button 81 so that the equilibrium valve (not shown) closes after the flush is initiated, with the weight 52 forcing the piston 5 downward such that the first portion 70 of the piston rod 50 fits loosely within the hole 41 of the chamber 4, thereby providing a vertical passage therebetween to break the siphonic action when the water level drops below the hole 41.

Clearly, the reverse of the partial flush arrangement described above is also envisaged. This may be achieved, for example, by configuring the syphon assembly 1 as described in GB2329398, the entire contents of which are incorporated herein by reference.

Figure 14:
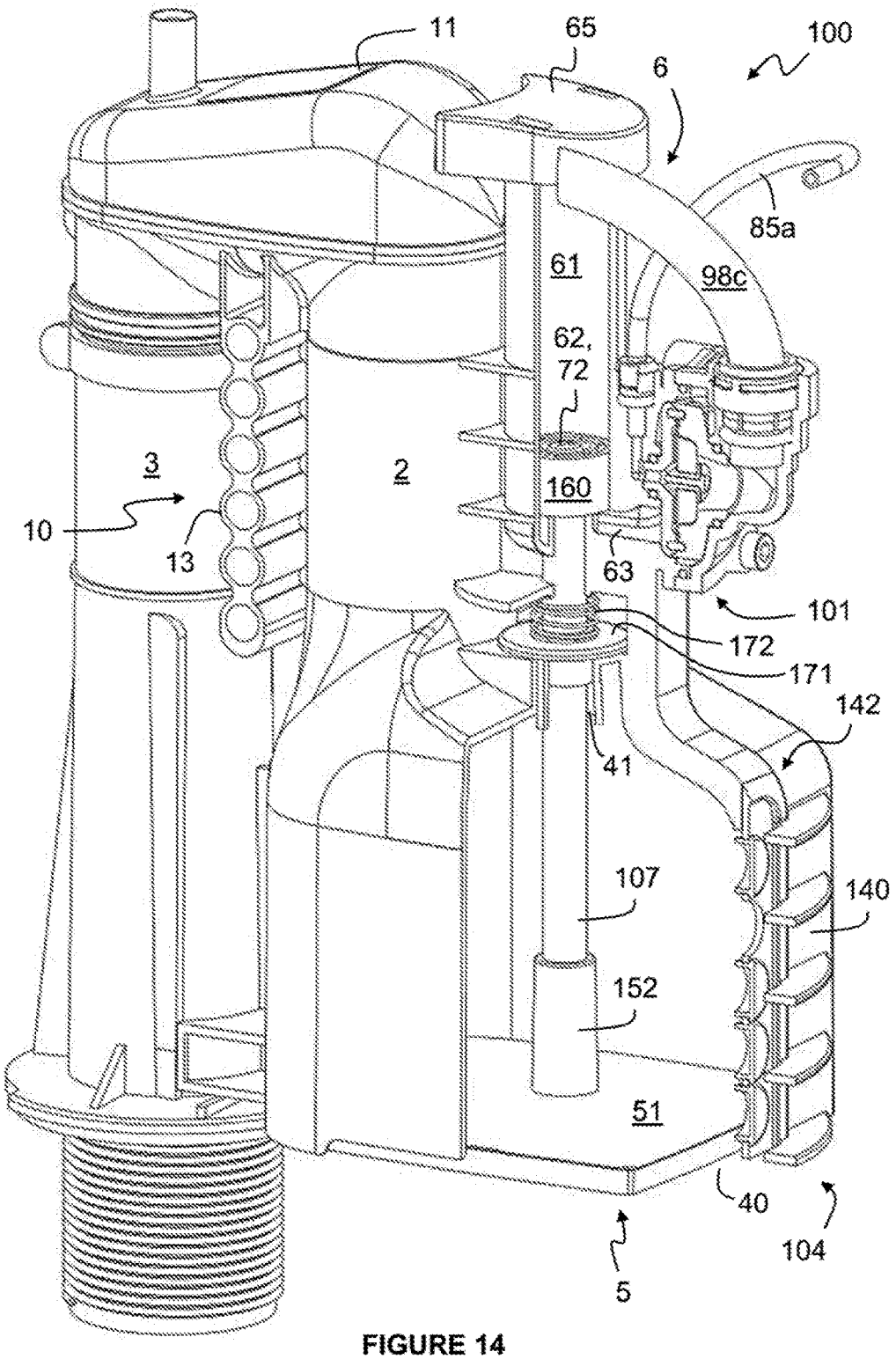
FIG. 14 is a partially segmented perspective view of syphon assembly according a second embodiment.

Turning now to FIG. 14, there is shown a syphon assembly 100 according to a second embodiment, which is similar to the syphon assembly 1 according to the first embodiment, wherein like references depict like features that will not be described further. The syphon assembly 100 according to this embodiment differs from that of the first embodiment in that the equilibrium valve 101 is mounted directly to the hydraulic actuator 6, the means by which a partial flush is achieved has been reconfigured, the weight 52 is incorporated within the actuator piston 160 and piston rod 107 and the adaptable flush volume feature 142 has been reconfigured for improved access and strength.

Figure 15:
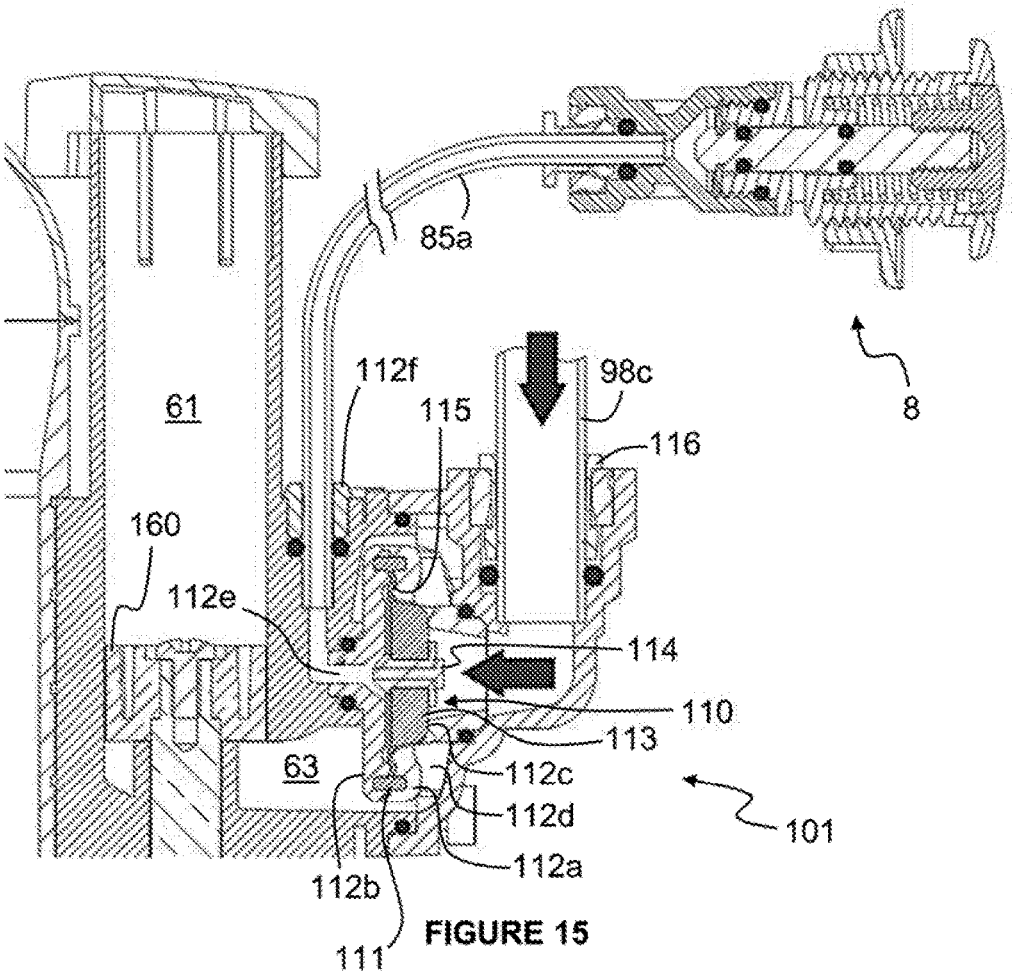
FIG. 15 is a section view of the actuation system of the syphon assembly of FIG. 14 illustrating the flush activator operatively connected to the equilibrium valve and showing the flow of mains water into the equilibrium valve.
Figure 16:
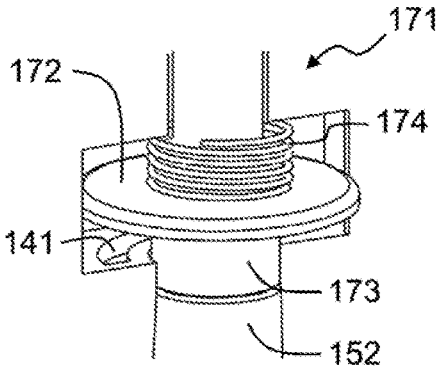
FIG. 16 is a partial perspective view of the partial flush closure element of the syphon assembly of FIG. 14 shown in an open position.
Figure 17:
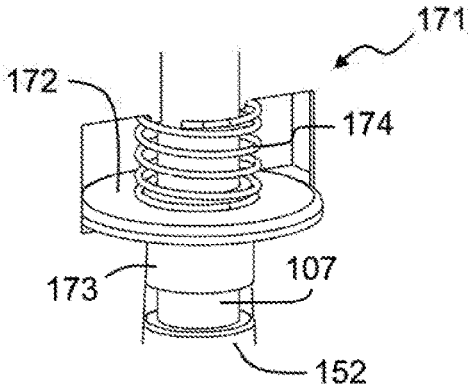
FIG. 17 is a view similar to that of FIG. 16 but showing the partial flush closure element in a closed position.
Figure 18:
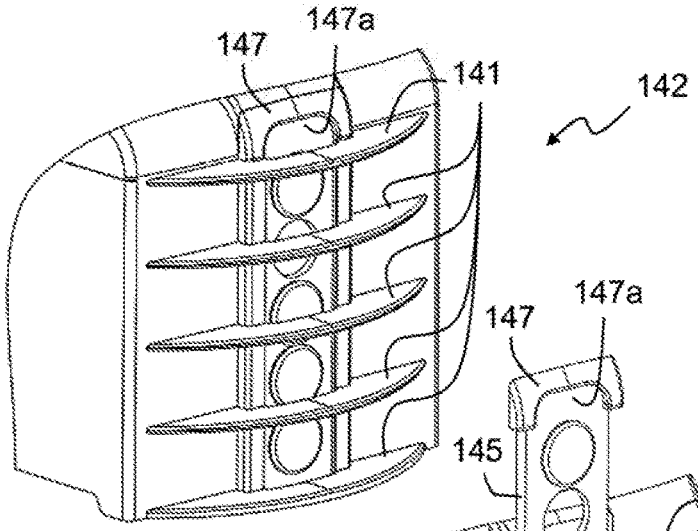
FIGS. 18, 19 and 20 are partial perspective views of the adaptable flush volume feature of the syphon assembly of FIG. 14 shown with the closure element installed partially removed and fully removed positions respectively.

The equilibrium valve 101 in this embodiment functions in a manner that is similar in principle to the diaphragm valves 90, 190 of the fill valve assemblies 9, 109 described above. Specifically, the equilibrium valve 101 includes a diaphragm 110 with a peripheral flange 111 captivated between opposed housing portions 112*a*, 112*b*, a central valve portion 113 with a central hole incorporating a flow regulation pin 114 and a flexible bridging portion 115 joining the peripheral flange 111 to the valve portion 113. As shown in FIGS. 14 and 15, the downstream side of the diaphragm 110 has a larger surface area exposed to fluid pressure than the upstream side thereof. The upstream housing portion 112*a* includes a valve seat 112*c* and a plurality of radial outlets 112*d* fluidly connected to the inlet 63 of the actuator 6. The downstream housing portion 112*b* includes a central outlet 112*e* that feeds the tube 85*a* connected to the flush activator 8 at one end and to a push fit fitting 112*f* mounted to the actuator 6 at the other end. The mains water inlet tube 98*c* is connected to the equilibrium valve 101 by a push fit fitting 116.

In use and with the activator 8 in the position shown in FIGS. 5 and 15, water pressure on opposite sides of the diaphragm 110 is kept substantially in equilibrium, which causes the valve portion 113 of the diaphragm 110 to be biased against the valve seat 112*c* on the upstream housing portion 112*a*. When the pushbutton 81 of the activator 8 is depressed, the passage between the outlet 112*e* of the downstream housing portion 112*b* and the radial outlets 83*a* of the activator 8 is open, which reduces the pressure on the downstream side of the diaphragm 110, owing to the restricted flow of pressurised water passed the flow regulation pin 114. This in turn, unseats the diaphragm 110 and opens fluid flow between the mains water inlet tube 98*c* and the radial outlets 112*d* of the equilibrium valve 101 and drives the piston 160 to raise the piston rod 107 in order to initiate the flush.

The piston rod 107 in this embodiment has a constant diameter and is received within a spigot 152 connected to the syphon piston 5. An interrupted annular vent 141 surrounds the hole 41 in this embodiment, which vent 141 provides a vertical passageway joining the interior of the chamber 104 of the syphon assembly 100 to the inside of the cistern (not shown). The syphon assembly 100 includes a sealing element 171 in the form of a washer 172 with a hollow, cylindrical portion 173 depending therefrom and compression spring 174 all surrounding the piston rod 107. The washer 172 and spring 174 are captivated between the base of the actuator cylinder 61 and the top of the vent 141 such that the spring 174 urges the washer 172 against the top of the chamber 104 to seal the vent 141.

In use, when the piston rod 107 is raised to its uppermost position, the spigot 152 urges the cylindrical portion 173, raising sealing washer 172 against the bias of the spring 174, thereby exposing the vent 141. If the pushbutton 81 is held in a depressed position as shown in FIG. 6, the flush continues until the water level reaches the vent 141, at which point the syphonic action is interrupted to provide a partial flush. If the pushbutton 81 is depressed and released, the syphon piston 5 drops as the water in the actuator cylinder 61 flows around the piston 160 and the sealing washer 172 is urged against the vent 141 under the influence of the biasing spring 174. The use of a compression spring 174 is particularly advantageous because it ensures that the vent 141 is sealed before the water level drops to the level of the vent 141, which could inadvertently result in a partial flush where a full flush is requested. In this embodiment, the piston 160 and rod 107 are both formed of a heavier material than that of the first embodiment, for example a brass material, in order to obviate the need for a separate weight 52 as in the syphon assembly 1 according to the first embodiment.

Figure 19:
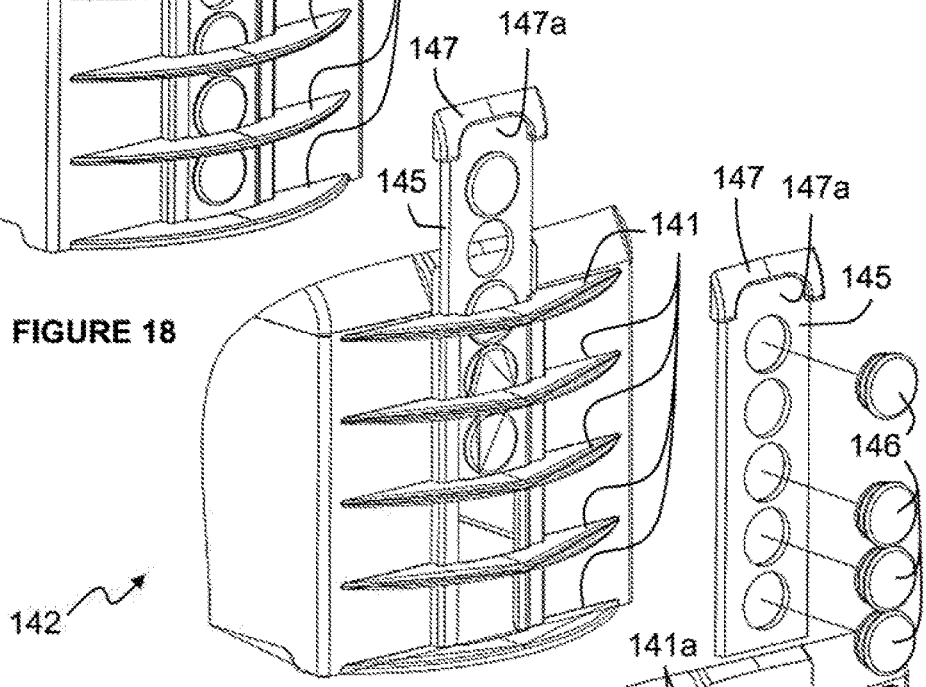
Figure 20:
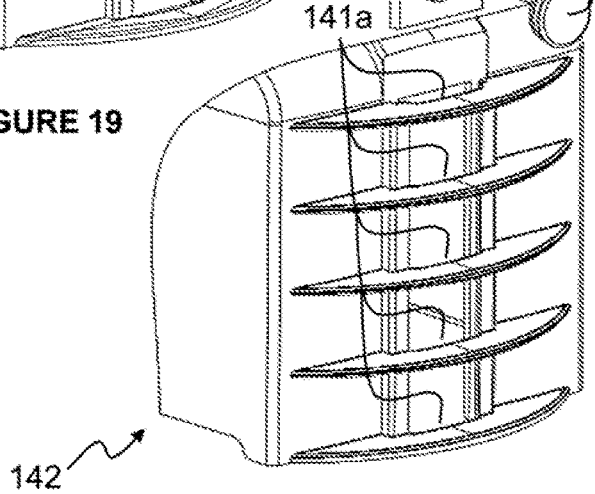

The adaptable flush volume feature 142 in this embodiment is incorporated with the outer, short side 140 of the chamber 104, as shown more clearly in FIGS. 19 and 20. In this embodiment, chamber 104 includes a plurality of horizontal reinforcing ribs 141 spaced vertically along its height. The chamber 104 includes an elongate opening 143 extending vertically with an open bottom and a closed top similar to the slot 43 of the syphon 1 of the first embodiment. However, engagement between the opening 143 and the closure element 145 in this embodiment is provided by respective cutouts 141*a* in each reinforcing rib 141 extending through its thickness on the side thereof adjacent the opening 143, thereby providing an interrupted vertical slot that is open at its upper end.

Each cutout 141*a* is substantially rectangular with an enlarged central portion to permit the removable plugs 146 of the closure element to pass therethrough. In this embodiment, there is provision for up to five removable plugs 146 only four of which are shown. The closure element 145 includes an upper flange 147 with a curved recess 147*a*, wherein the outer portions of the flange 147 abut the region of the uppermost reinforcing rib 141 surrounding the cutout 141*a* when the closure element 145 is received therein in order to hold it in place. Thus, the closure element 145 can be removed from above by simply placing a finger within the recess 147*a* and lifting the closure element 145, which is particularly advantageous as this can be done with the syphon 100 located in situ within the cistern (not shown).

It will be appreciated by those skilled in the art that several variations are envisaged without departing from the scope of the invention. For example, the hydraulic actuator 6 may be replaced with a pneumatic, electromagnetic or any other power-driven actuator. Accordingly, the source of power that drives the actuator may be provided by any other suitable means. Furthermore, the weight 52 may be replaced by any suitable biasing means, such as a spring or other such arrangement. The partial flush means need not be provided by an undersized portion of the piston rod 7 or even a vertical passage as described. Any other partial flush means may be provided. The syphon assembly 1 need not include an adjustment means 10 or may incorporate some other adjustment means.

It will be appreciated by those skilled in the art that any number of combinations of the aforementioned features and/or those shown in the appended drawings provide clear advantages over the prior art and are therefore within the scope of the invention described herein.

The invention claimed is:

1. A syphon assembly for discharging water from a cistern, the assembly comprising an inverted generally U shaped duct having an upleg and a downleg, an open-ended chamber fluidly connected to the upleg, a piston movable in the chamber, a hydraulically-driven actuator operatively connected to the piston and a piston rod with a first end connected to or formed integrally with the piston and a second end connected to or formed integrally with a prime mover of the actuator, wherein the actuator is operable, in use, to move or at least assist in the movement of the piston within the chamber to initiate a syphonic flushing action.

2. A syphon assembly as claimed in claim 1, wherein the actuator is a hydraulic actuator fluidly connected or connectable, in use, to a mains water supply.

3. A syphon assembly as claimed claim 1, wherein the actuator comprises an actuator cylinder and the prime mover comprises an actuator piston reciprocable within the actuator cylinder.

4. A syphon assembly as claimed in claim 3, wherein the actuator cylinder comprises an inlet at or adjacent a first of its ends and a vent or vents at or adjacent at a second of its ends.

5. A syphon assembly according to claim 3, wherein the actuator piston is sized and/or dimensioned such that a fluid flow entering the cylinder from the inlet forces the piston from the first end toward the second end and such that fluid is able to flow between the piston head and the cylinder.

6. A syphon assembly according to claim 1 further comprising a control valve mechanism connected to the actuator for controlling the actuator.

7. A syphon assembly according to claim 6 further comprising a control lever or button or proximity sensor or switch for operating the control valve mechanism.

8. A syphon assembly according to claim 6, wherein the control valve mechanism comprises an operating valve and a pilot valve.

9. A syphon according to claim 8, wherein the operating valve is mounted to, or remote from, the chamber.

10. A syphon assembly according to claim 8, wherein the operating valve comprises an equilibrium valve and the pilot valve comprises a bleed valve.

11. A syphon assembly according to claim 6 further comprising a fill valve assembly including a branch element fluidly connected to the control valve mechanism for supplying mains water thereto.

12. A syphon assembly according to claim 1 further comprising a dual flush mechanism for enabling a user to selectively operate the assembly to flush all or only some of the contents of a cistern to which the syphon assembly is connected in use, wherein the assembly comprises a passage extending from the interior of the chamber to the interior of a cistern in use at a position that is higher than the open end of the chamber and a seal biased to a closed position in which the passage is closed, wherein the assembly is configured such that the seal is moved from the closed position or condition to an open position or condition only when the piston is at or adjacent a fully raised or uppermost position such that a maximum volume flush can be effected by raising the piston and allowing it to drop to an intermediate position below its fully raised or uppermost position without delay, but a lesser volume flush can only be effected by holding the piston in a substantially fully raised or uppermost position until the water level drops below the passage opening allowing air to enter the chamber and interrupting the syphonic action.

13. A kit of parts for assembly into an assembly according to any one of claim 1, the kit comprising an inverted generally U shaped duct having an upleg and a downleg, an open-ended chamber fluidly connected or connectable to the upleg, a piston for movable receipt within the chamber, a hydraulically-driven actuator operatively connected to the piston and a piston rod with a first end connectable to or formed integrally with the piston and a second end connectable to or formed internally with a prime mover of the actuator.

14. A cistern comprising an assembly according to claim 1.

15. A toilet comprising a cistern according to claim 14.

16. A syphon assembly for discharging water from a cistern, the assembly comprising an inverted generally U shaped duct having an upleg and a downleg, an open-ended chamber fluidly connected to the upleg, a piston movable in the chamber, a hydraulically-driven actuator operatively connected to the piston and a dual flush mechanism for enabling a user to selectively operate the assembly to flush all or only some of the contents of a cistern to which the syphon assembly is connected in use, wherein the actuator is operable, in use, to move or at least assist in the movement of the piston within the chamber to initiate a syphonic flushing action, the assembly comprising a passage extending from the interior of the chamber to the interior of a cistern in use at a position that is higher than the open end of the chamber and a seal biased to a closed position in which the passage is closed, the assembly being configured such that the seal is moved from the closed position or condition to an open position or condition only when the piston is at or adjacent a fully raised or uppermost position such that a maximum volume flush can be effected by raising the piston and allowing it to drop to an intermediate position below its fully raised or uppermost position without delay, but a lesser volume flush can only be effected by holding the piston in a substantially fully raised or uppermost position until the water level drops below the passage opening allowing air to enter the chamber and interrupting the syphonic action.

* * * * *